US005828017A

United States Patent [19]

Fiorini et al.

[11] Patent Number: 5,828,017

[45] Date of Patent: Oct. 27, 1998

[54] ELECTRICAL SWITCH ASSEMBLY

[75] Inventors: Joseph Fiorini, Newmarket; Cong Doan, Willowdale, both of Canada

[73] Assignee: LaPrairie Electrical Products, Markham, Canada

[21] Appl. No.: 714,472

[22] Filed: Sep. 16, 1996

[51] Int. Cl.[6] ..... H01R 11/11

[52] U.S. Cl. ..... 200/17 R; 439/479

[58] Field of Search ..... 200/1 R, 1 A, 200/51 R, 17 R, 18, 51.09, 51.13, 51.07; 218/1, 2, 8; 439/115, 188, 189, 214, 266, 299, 296, 300, 310, 507, 477–481, 502, 801, 823, 826, 842, 848, 851

[56] References Cited

U.S. PATENT DOCUMENTS

| | | | |
|---|---|---|---|
| 2,013,507 | 9/1935 | Schwarz | 173/273 |
| 2,472,000 | 5/1949 | Bowen | 200/51.07 |
| 2,874,364 | 2/1959 | Graham | 339/109 |
| 3,668,341 | 6/1972 | Smedley et al. | 200/48 R |
| 3,794,963 | 2/1974 | Cooper, Jr. | 339/242 |
| 3,923,363 | 12/1975 | Kraft | 339/97 R |
| 4,298,240 | 11/1981 | Grillet | 339/109 |

*Primary Examiner*—Cassandra C. Spyrou
*Assistant Examiner*—Michael A. Friedhofer
*Attorney, Agent, or Firm*—Ridout & Maybee

[57] ABSTRACT

An electrical switch apparatus suitable for isolating high voltage equipment and bus-bar systems in utility sub-stations. The switch apparatus comprises a pair of detachable couplers which are connected by a high voltage flex cable, and a pair of terminal adapters. The terminal adapters are connected to respective terminals of the bus-bar or other sub-station equipment. The terminal adapters each include a member for engaging one of the couplers and forming a conductive path between the terminals. To break the conductive path, one or both of the couplers are conveniently detached using a hook-stick. The switch apparatus is easily adapted to various spacings and provides a convenient replacement for conventional blade disconnect switches.

7 Claims, 2 Drawing Sheets

ELECTRICAL SWITCH ASSEMBLY

FIELD OF THE INVENTION

The present invention relates to electrical switchgear, and more particularly to a switch assembly for electrical sub-stations.

BACKGROUND OF THE INVENTION

Electrical switches or switchgear are used primarily for isolation of equipment such as transformers or other live high voltage equipment in electrical sub-stations. The switches provide a means for sectionalizing electric equipment and circuits such as transformers or lateral circuits or portions of main feeders for special purposes such as maintenance and testing.

Most existing disconnect switches installed in electrical sub-stations are of the well-known "blade" type. A major problem faced by the electrical utilities is that after years of use the blades tend to deform. The deformation of the blade, in turn, creates hot spots and thereby further weakens the electrical apparatus. Wear and tear of this nature will typically take ten or more years before it causes a problem necessitating replacement. During this time, replacement parts for the blade switch often become obsolete or not readily available when it comes to replacement of the old worn assembly.

In order to replace the old blade switches, the electrical utilities often must have the parts custom made. As will be appreciated the tooling costs multiplied by the number of switches can represent a significant expenditure for the electrical utility without no real reciprocal benefit other than maintenance of the existing physical plant.

Another alternative for utilities is to simply replace the old blade switches with new switches. New "off-the-shelf" blade switches will typically be cheaper than custom machined components or switches. However, new replacement switches often are manufactured according to new product designs and spacings (e.g. blade length) and therefore must be altered in order to fit existing and incompatible high voltage bus-bar systems. Since alterations inevitably entail custom machining, further costs must be incurred in order to retrofit the switches to the existing bus bar configurations.

Accordingly, there remains a need for electrical switchgear which is readily adaptable to new installations as well as older or non-standard installations.

BRIEF SUMMARY OF THE INVENTION

The present invention provides an electrical switch which is adaptable to new and existing installations, and is particularly suited for high voltage equipment and bus-bar systems in utility sub-stations.

The present invention provides an electrical switching apparatus for isolating equipment in an electrical circuit, said electrical switching apparatus comprising: (a) first and second detachable couplers; (b) a flexible conductor connecting said first and second detachable couplers; (c) first and second terminal means, said terminal means including means for engaging said first and second detachable couplers and forming a conductive path; and (d) said first and second terminal means further including means for connecting to respective terminals of said electrical equipment and continuing said conductive path when said first and second detachable couplers are engaged.

In another aspect, the present invention provides an electrical switch apparatus for isolating equipment in an electrical circuit, said electrical switch apparatus comprising: (a) first and second pigtail couplers; (b) a flexible conductor connecting said first and second pigtail couplers; (c) first and second terminal adapters, said terminal adapters including post members for receiving said first and second pigtail couplers, said pigtail couplers having wedge locking members for engaging said post members and forming a conductive path; and (d) said first and second terminal adapters further including means for connecting to respective terminals of said electrical equipment and continuing said conductive path when said first and second pigtail couplers are engaged.

BRIEF DESCRIPTION OF THE DRAWINGS

Reference will now be made, by way of example, to the accompanying drawings which show a preferred embodiment of the present invention, and in which.

DETAILED DESCRIPTION OF THE PREFERRED EMBODIMENTS

Figure 1:
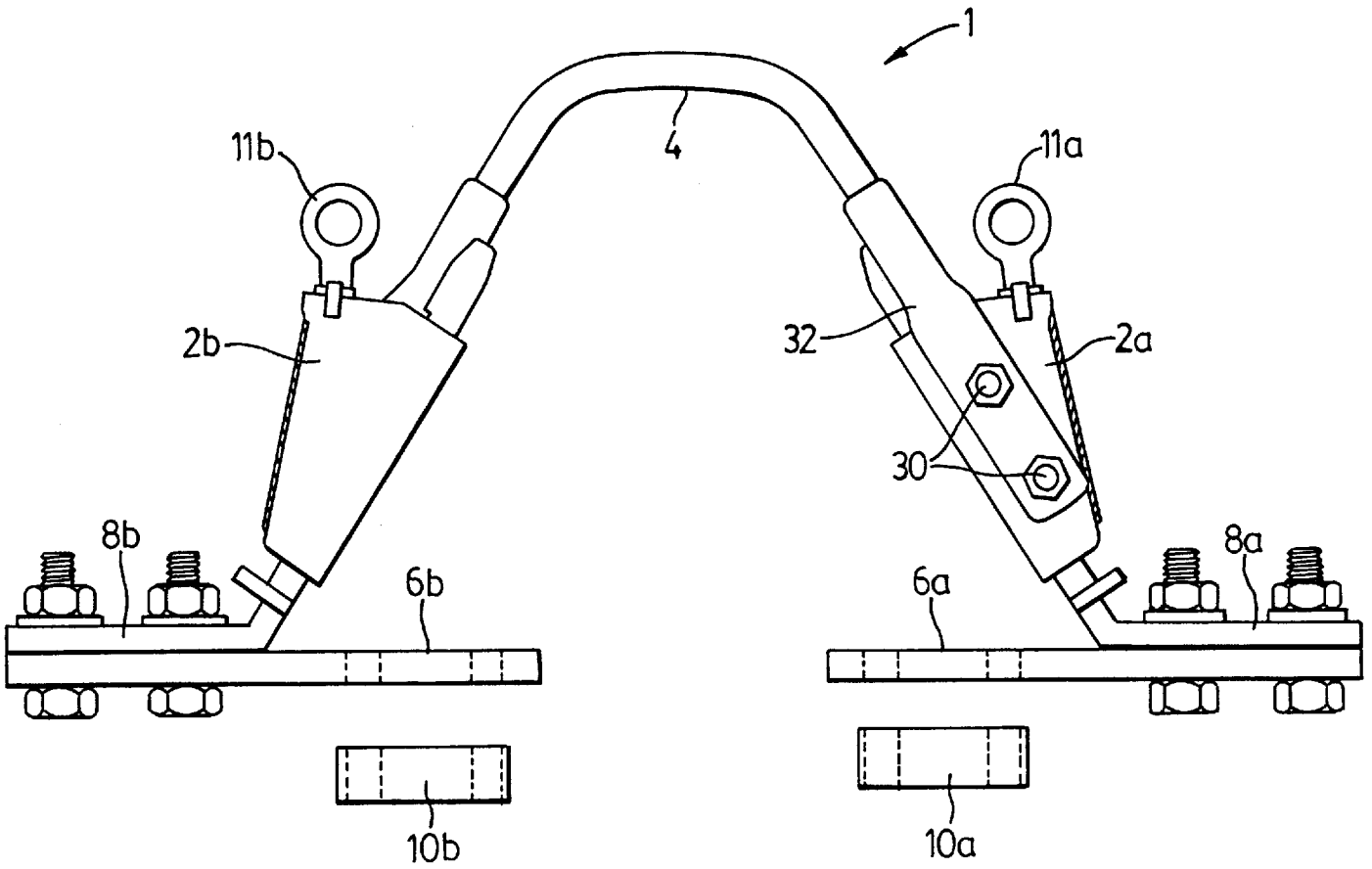
FIG. 1 shows an electrical switch assembly according to the present invention.

Reference is first made to FIG. 1 which shows an electrical switch assembly according to the present invention. The electrical switch assembly is indicated generally by reference 1.

The electrical switch 1 would typically be installed on an electrical circuit at a utility sub-station. The switch is primarily used by electrical crews at sub-stations to isolate a specific piece of equipment, for example a transformer, to be worked on, without having to de-energize the whole high voltage circuit. The switch also creates a safe de-energized work area for electrical personnel doing the repair or maintenance.

The electrical switch 1 comprises first and second detachable connectors or couplers 2*a,* 2*b* and a high voltage flex cable 4. The length of the cable 4 is determined based on the voltage in the circuit as will be understood by one skilled in the art. The detachable connectors 2 preferably comprise the "pigtail-type" connector by LaPraire Electrical Products of Markham, Ontario. The pigtail connector advantageously includes an eye-bolt wedge mechanism for opening and closing the switch. The pigtail connector is shown in more detail in FIG. 3.

The switch assembly 1 includes a pair of adapter plates 6*a,* 6*b* and stud-to-pad adapters 8*a,* 8*b* for coupling the electrical switch 1 to an electrical apparatus, for example a high voltage transformer (not shown), at the utility substation. The adapter plates 6*a,* 6*b* are bolted to the respective pad adapters 8*a,* 8*b* and also to respective ends 10*a,* 10*b* of a bus-bar 10 on the high voltage transformer (not shown).

Figure 2:
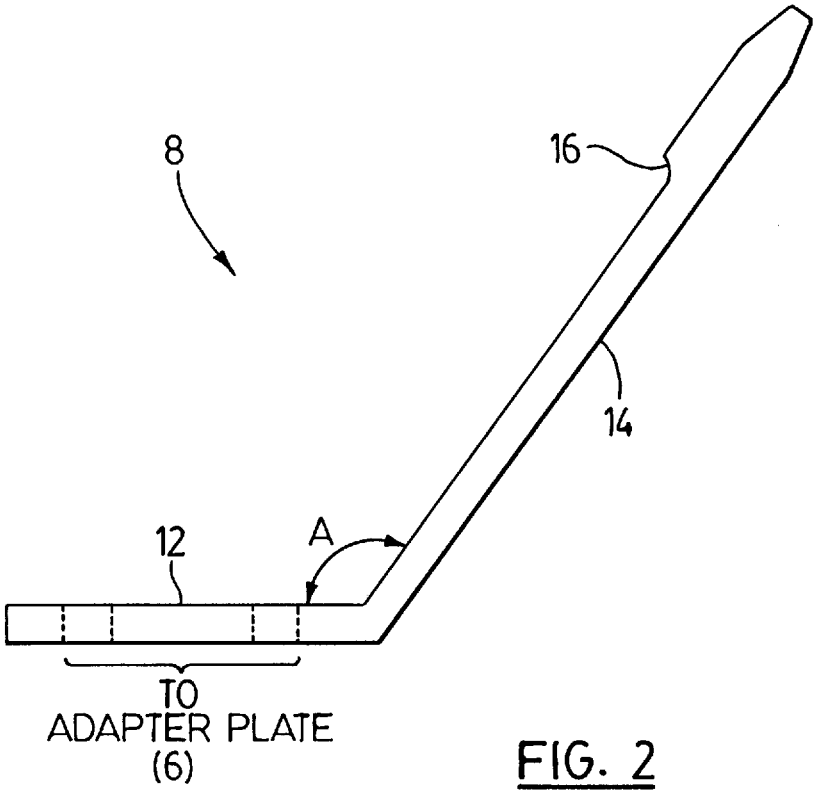
FIG. 2 shows a stud-to-pad adapter for the electrical switch assembly of FIG. 1.

As shown in FIG. 2, the stud-to-pad adapter 8 comprises a base member 12 and a post member 14. The post member 14 forms an angle A with the base member 12 of about 140°. The base member 12 bolts to the adapter plate 6 (as shown in FIG. 1), and the post member 14 receives the detachable connector 2. It is preferable to angle the post members 14 in order to facilitate the removal and installation of the detachable connectors 2*a,* 2*b*.

While the detachable connectors 2 preferably include a locking mechanism for coupling to the stud-to-pad adapters 8, the post member 14 may also include a flange 16 as shown in FIG. 2. The primary function of the flange 16 is to securely engage the detachable connector 2 and prevent the connector 2 from popping off the post 14 in the event of a high voltage surge through the electrical equipment. The flange 16 locks with the eye-bolt wedge mechanism in the pigtail-type connector 2.

Figure 3:
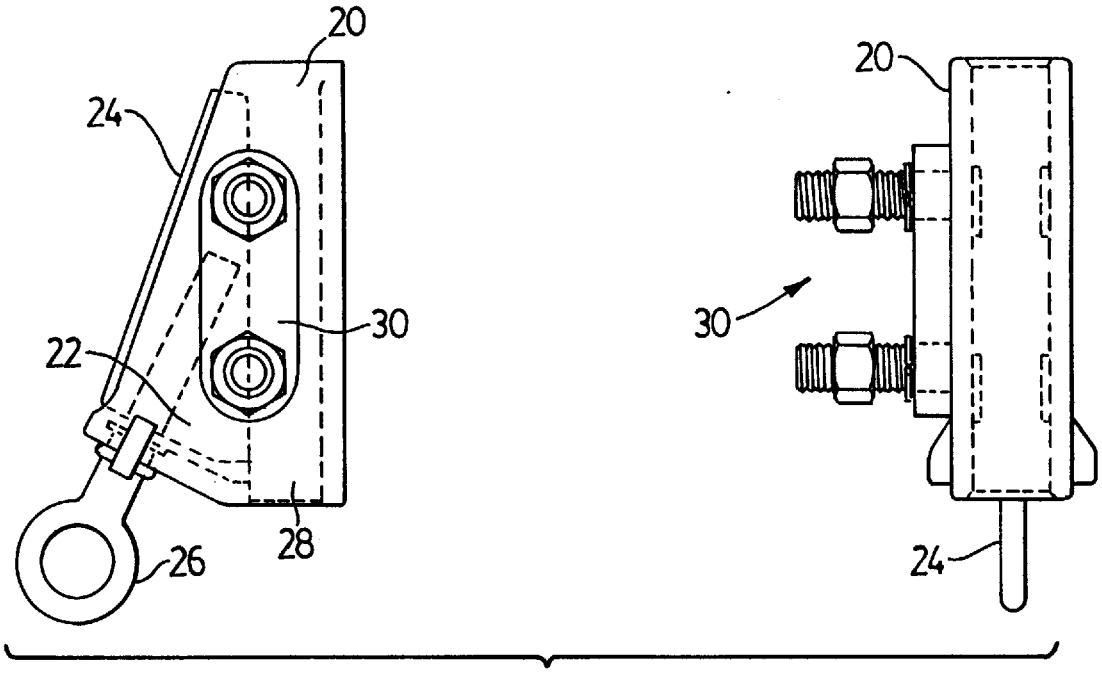
FIG. 3 shows a pigtail connector for the electrical switch of FIG. 1.

As shown in FIG. 3, the pigtail connector 2 comprises a body casting 20. The body casting 20 includes a cavity 22 into which slidably fits a wedge shaped member 24. An eye-screw 26 or hook-ring is attached to the wedge member 24. The body 20 also includes a channel 28. The channel 28 receives the post member 14 and is engaged by the wedge member 24 and further secured by the flange 16. To disengage the post member 14, the wedge 24 is retracted by rotating the hook-ring 26. The flex cable 4 is electrically coupled to the body 20 by studs 30 which secure a 2-holed NEMA-type lug 32 (FIG. 1).

To replace an existing blade-type disconnect switch, the blade switch is removed, and the adapter plates 6 are bolted to the existing bus-bar 10. Once the stud-to-pad adapters 8 are connected, the detachable connectors 2 and cable 4 are coupled to the pad adapters 8. By varying the length of the cable 4, the switch assembly 1 is readily adapted to replace various length disconnect blade switches. The installation and disconnection of the switch 1 is further enhanced by utilizing "pigtail-type" devices for the connectors 2.

In operation, the high voltage transformer (or other circuit element) in the sub-station is isolated by disconnecting one or both of the detachable connectors 2*a,* 2*b.* Disconnecting both connectors 2*a,* 2*b* is preferred in order to prevent contact and hazardous shock to personnel working in the vicinity. As shown in FIG. 1, each of the connectors 2*a,* 2*b* includes a ring or loop 11 for receiving a hook-stick (or "hotstick"). By turning the ring 11, the connector 2*a* is easily removed from the post member 14 on the stud-to-pad adapter 8 and the circuit is broken thereby isolating a high voltage transformer, for example. The other connector 2*b* is also similarly disengaged. Once the work is completed, the connector(s) 2 are engaged to the stud-to-pad adapter(s) 8 to restore the electrical connection.

In summary, the electrical switch assembly according to the present invention provides a cost effective replacement for existing disconnect blade switches. Furthermore, the electrical switch assembly is adaptable to existing bus-bar configurations and easily installed.

The present invention may be embodied in other specific forms without departing from the spirit or essential characteristics thereof. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An electrical switch apparatus for isolating equipment in an electrical circuit, said electrical switch apparatus comprising:

(a) first and second detachable couplers;

(b) a flexible conductor connecting said first and second detachable couplers;

(c) first and second terminal means, said terminal means including means for engaging said first and second detachable couplers and forming a conductive path, wherein detaching one of said couplers breaks said conductive path, and said first and second terminal means further including means for securing said detachable couplers when engaged;

(d) said first and second terminal means further including means for connecting to respective terminals of said electrical equipment and continuing said conductive path when said first and second detachable couplers are engaged; and (e) wherein said detachable couplers comprise pigtail connectors having a wedge locking member.

2. The electrical switch apparatus as claimed in claim 1, wherein said means for securing said detachable couplers comprises a flange for engaging said wedge locking member in said pigtail connector.

3. An electrical switch apparatus for isolating equipment in an electrical circuit, said electrical switch apparatus comprising:

(a) first and second detachable couplers;

(b) a flexible conductor connecting said first and second detachable couplers;

(c) first and second terminal means, said terminal means including means for engaging said first and second detachable couplers and forming a conductive path; said means for engaging comprising a post member;

(d) said first and second terminal means further including means for connecting to respective terminals of said electrical equipment and continuing said conductive path when said first and second detachable couplers are engaged; and (e) wherein said detachable couplers comprise a pigtail connector having a wedge locking member.

4. The electrical switch apparatus as claimed in claim 3, wherein said post member includes a flange for engaging said wedge locking member in said pigtail connector.

5. An electrical switch apparatus for isolating equipment in an electrical circuit, said electrical switch apparatus comprising:

(a) first and second pigtail couplers;

(b) a flexible conductor connecting said first and second pigtail couplers;

(c) first and second terminal adapters, said terminal adapters including post members for receiving said first and second pigtail couplers, said pigtail couplers having wedge locking members for engaging said post members and forming a conductive path; and (d) said first and second terminal adapters further including means for connecting to respective terminals of said electrical equipment and continuing said conductive path when said first and second pigtail couplers are engaged.

6. The electrical switch apparatus as claimed in claim 5, wherein disconnecting one of said pigtail couplers breaks said conductive path.

7. The electrical switch apparatus as claimed in claim 6, wherein said post members include a flange portion for engaging said wedge locking member and securing said pigtail couplers when engaged to said post members.

* * * * *